US006113204A

United States Patent [19]

Jährling et al.

[11] Patent Number: 6,113,204

[45] Date of Patent: Sep. 5, 2000

[54] TRACK ASSEMBLY FOR A PULL-OUT MEMBER

[75] Inventors: Peter Jährling, Bünde; Ralf Menkhaus, Osnabrück; Jürgen Bachor, Kirchlengern, all of Germany

[73] Assignee: Paul Hettich GmbH & Co., Kirchlengern, Germany

[21] Appl. No.: 09/246,302

[22] Filed: Feb. 8, 1999

[30] Foreign Application Priority Data

Feb. 24, 1998 [DE] Germany ..... 298 03 210 U

[51] Int. Cl.[7] ..... A47B 88/04

[52] U.S. Cl. ..... 312/334.31; 312/319.1; 312/334.44

[58] Field of Search ..... 312/410, 319.1, 312/334.4, 334.6, 334.11, 334.14, 334.15, 334.17, 334.31, 334.32, 334.33, 334.36, 334.38, 334.44; 384/18, 21

[56] References Cited

U.S. PATENT DOCUMENTS

| | | | |
|---|---|---|---|
| 4,469,384 | 9/1984 | Fler et al. | 312/333 |
| 5,020,869 | 6/1991 | Faust | 312/334.15 |
| 5,143,432 | 9/1992 | Ohshima et al. | 312/334.17 X |
| 5,344,228 | 9/1994 | Kovarik et al. | 312/334.17 X |
| 5,417,489 | 5/1995 | Compagnucci | 312/334.17 X |

FOREIGN PATENT DOCUMENTS

| | | | |
|---|---|---|---|
| 33 29 541 A1 | 3/1985 | Germany . | |
| 3436393 A1 | 4/1986 | Germany | 312/334.32 |
| 92/19131 | 11/1992 | WIPO | 312/334.44 |

*Primary Examiner*—Janet M. Wilkens
*Attorney, Agent, or Firm*—Henry M. Feiereisen

[57] ABSTRACT

A track assembly for a pull-out member, such as a drawer for a piece of furniture or an oven tray for cooked food, includes a stationary guide rail, a runner slidable with respect to the guide rail in an operating direction between extracted and retracted positions and coupled to a pull-out slide member, and a spring-biased brake mechanism mounted transversely to the operating direction of the runner and bearing upon at least one flank of the runner, to thereby impede a smooth run between the runner and the guide rail of the track assembly in cases in which a certain degree of sluggishness is desired.

11 Claims, 7 Drawing Sheets

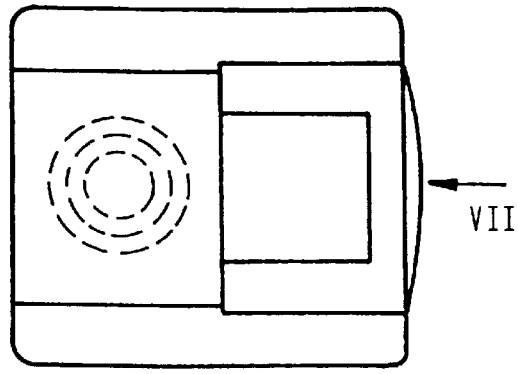
FIG. 6
FIG. 5
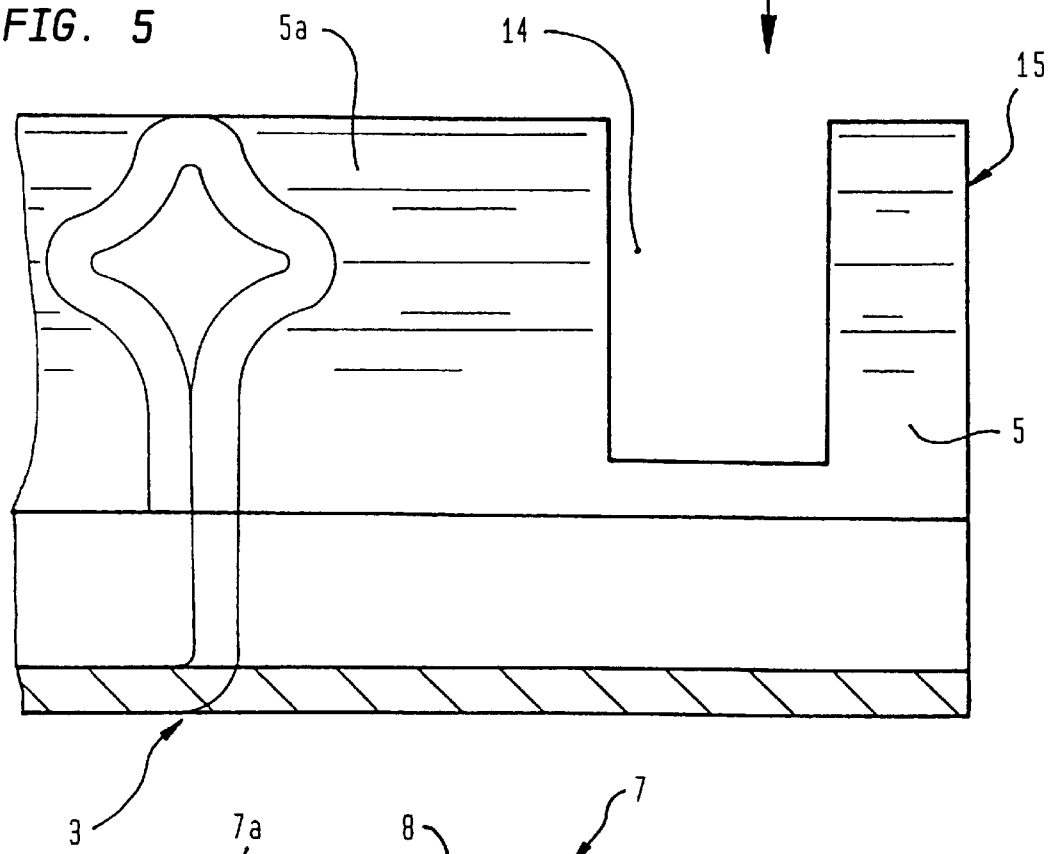
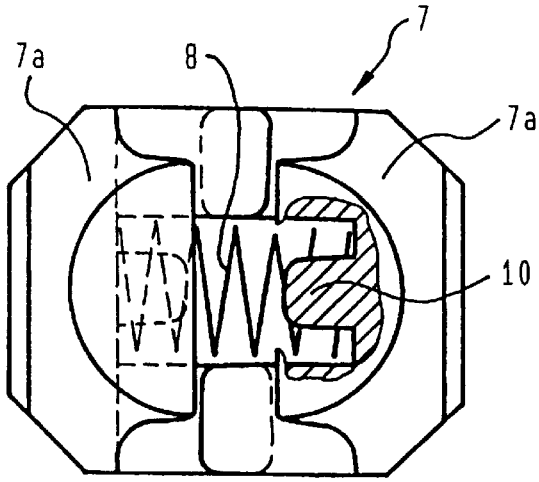
FIG. 7

TRACK ASSEMBLY FOR A PULL-OUT MEMBER

CROSS-REFERENCES TO RELATED APPLICATIONS

This application claims the priority of German Patent Application Serial No. 298 03 210.4, filed Feb. 24, 1998, the subject matter of which is incorporated herein by reference.

BACKGROUND OF THE INVENTION

The present invention relates, in general, to a track assembly for pull-out members, such as a drawer for a piece of furniture or an oven tray for cooked food, and relates in particular to a track assembly of a type including a stationary guide rail and a runner movable with respect to the guide rail in an operating direction between extended and retracted positions, and coupled to a pull-out slide member.

Track assemblies of varying types for use in different fields of application are generally known and used. In general, conventional track assemblies attempt to create an extremely smooth travel between the runner relative and the guide rail. Therefore, manufacturers continuously aspire to provide track assemblies with especially smooth sliding action. As a consequence of the smooth sliding action of conventional track assemblies, the incorporation of a damping mechanism and a stop mechanism for restricting the travel motion becomes necessary, i.e. conventional track assemblies should be equipped with means that attenuate the smooth run shortly before reaching the final retracted position when the slide member is returned, to thereby avoid a hard impact in the final retracted position. These types of dampers oftentimes further assume the task as stops, i.e. that the guide rail, after rolling over or sliding over the damper mechanism, is safeguarded against unwanted disengagement, as disclosed, for example, in German Pat. No. DE OS 33 29 541.

Outside these areas of damping and stopping, the conventional track assemblies are designed to exhibit an extremely smooth run. However, there are circumstances when a smooth run, as realized heretofore, is not that desirable and even unacceptable in some extreme situations. An example of such a situation includes the use of track assemblies in oven trays for a baking oven. In these cases, when e.g. the oven is not placed on an even floor and has therefore even only a slight forward tilt, the oven tray carrying the hot food may slide out by itself upon opening of the access door. Although, it may be conceivable for situations like this to provide track assemblies that exhibit a more sluggish run; However, this would make it necessary for the manufacturer to provide different product lines and thus to produce different types of track assemblies to meet varying types of applications.

SUMMARY OF THE INVENTION

It is thus an object of the present invention to provide an improved track assembly for pull-out members, obviating the afore-stated drawbacks.

In particular, it is an object of the present invention to provide an improved track assembly which operates smoothly but can be so modified in a simple manner as to produce a sluggish sliding motion between the guide rail and the runner.

These objects, and others which will become apparent hereinafter, are attained in accordance with the present invention by incorporating in the track assembly a spring-biased brake mechanism which is mounted transversely to the operating direction of the runner and bears upon at least one flank of the runner.

Through the incorporation of a brake mechanism, a track assembly according to the present invention is able meet a dual objective, i.e. while the track assembly is constructed for a smooth and easy operation, it can be so modified in a simple manner as to exhibit a desired sluggish sliding motion between the guide rail and the runner when certain cases demand such a sliding motion. As all components of the track assembly normally used for realizing a smooth run can be employed to integrate the brake mechanism, the need for a separate production line is eliminated. Which type of sliding action is ultimately is selected for the track assembly can thus be decided as late as the final stage of assembly. Only at that stage does it become necessary to decide whether the normal smooth sliding action of the track assembly should be retained or, whether the desired attenuation and sluggishness should be provided by incorporating the spring-biased brake mechanism for interaction with the guide rail.

Of course, it is also possible to retrofit conventional track assemblies by subsequently installing a brake mechanism according to the present invention.

Suitably, the brake mechanism includes a damping element which projects beyond a front end face of the guide rail.

According to another feature of the present invention, the brake mechanism includes two plastic form-parts which can be pushed together for realizing an interlocking engagement, and at least one spring member, e.g. a helical spring of spring wire, which extends between the two from-parts for pushing apart the from-parts. Preferably, the two form-parts are permanently connected to each other by a film-type hinge.

According to another embodiment of the present invention, the brake mechanism includes a first brake member extending approximately parallel to the operating direction of the runner, a brake cam formed on the first brake member and bearing upon the flank of the runner, a second brake member projecting beyond a front end face of the guide rail and extending approximately perpendicular to the operating direction of the runner, and a spring member supported by the front end face of the guide rail for biasing the second brake member.

BRIEF DESCRIPTION OF THE DRAWING

The above and other objects, features and advantages of the present invention will now be described in more detail with reference to the accompanying drawing in which:

FIG. 5 is a cutaway view of the track assembly of FIGS. 3 and 4, showing in detail a front end of a guide rail forming part of the track assembly according to the present invention;

FIG. 6 is a side elevational view of a brake mechanism for interaction with the guide rail of FIG. 5;

FIG. 7 is a partially sectional view of the brake mechanism, taken along in direction of arrow VII in FIG. 6;

DETAILED DESCRIPTION OF PREFERRED EMBODIMENTS

Figure 1:
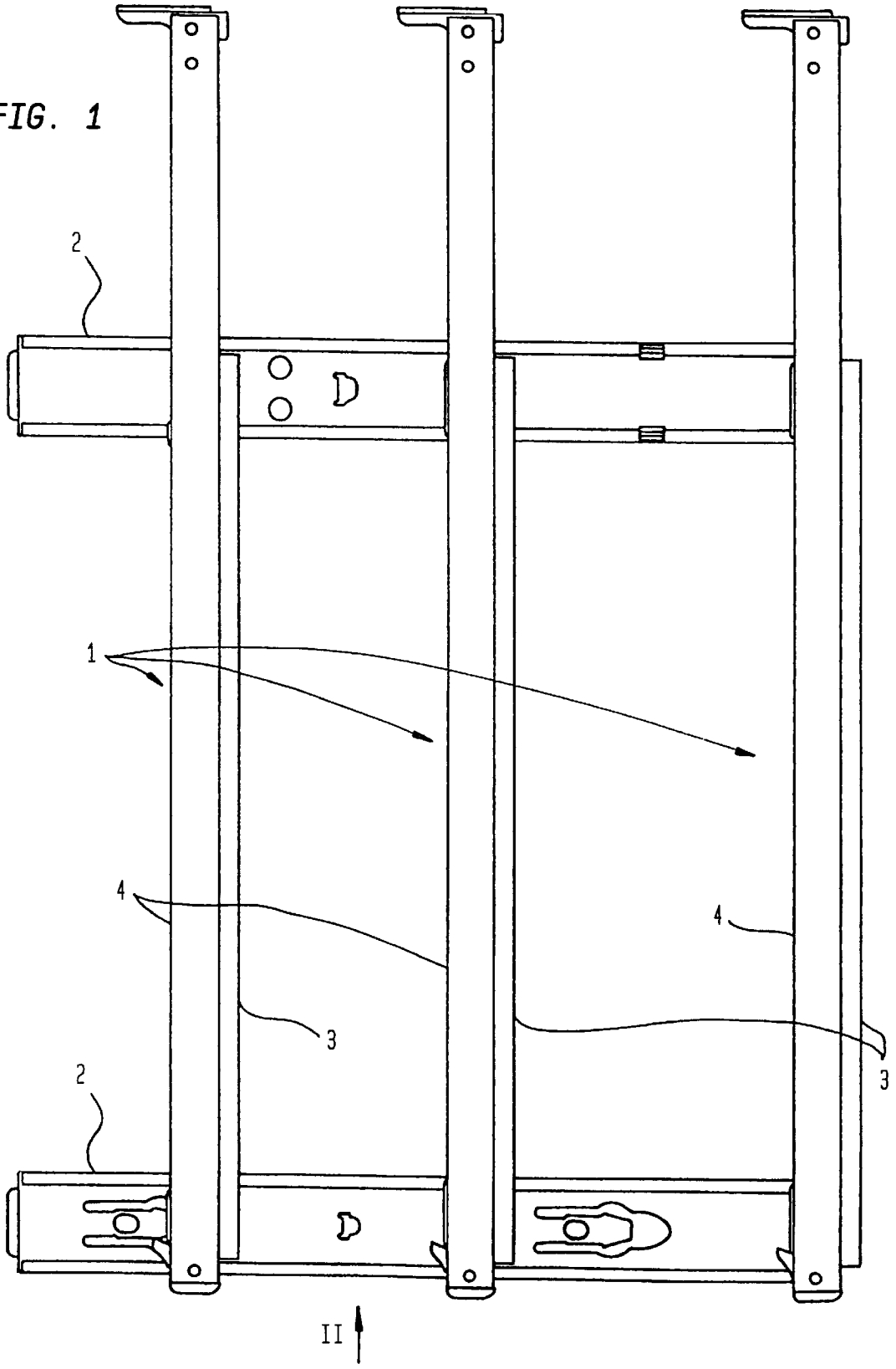
FIG. 1 is a schematic side view of an exemplified baking oven having incorporated therein several track assemblies for a cooking tray.

Throughout all the Figures, the same or corresponding elements are generally indicated by the same reference numerals.

Turning now to the drawing, and in particular to FIG. 1, there is shown a schematic side view of an exemplified baking oven having incorporated therein several track assemblies, generally designated by reference numerals 1, and used for cooking trays, e.g. racks or roasting pans. The track assemblies 1 are, for example, mounted interchangeably to vertical mounting rails 2 and may be completely removed from the interior of the oven and/or placed at various levels.

Figure 2:
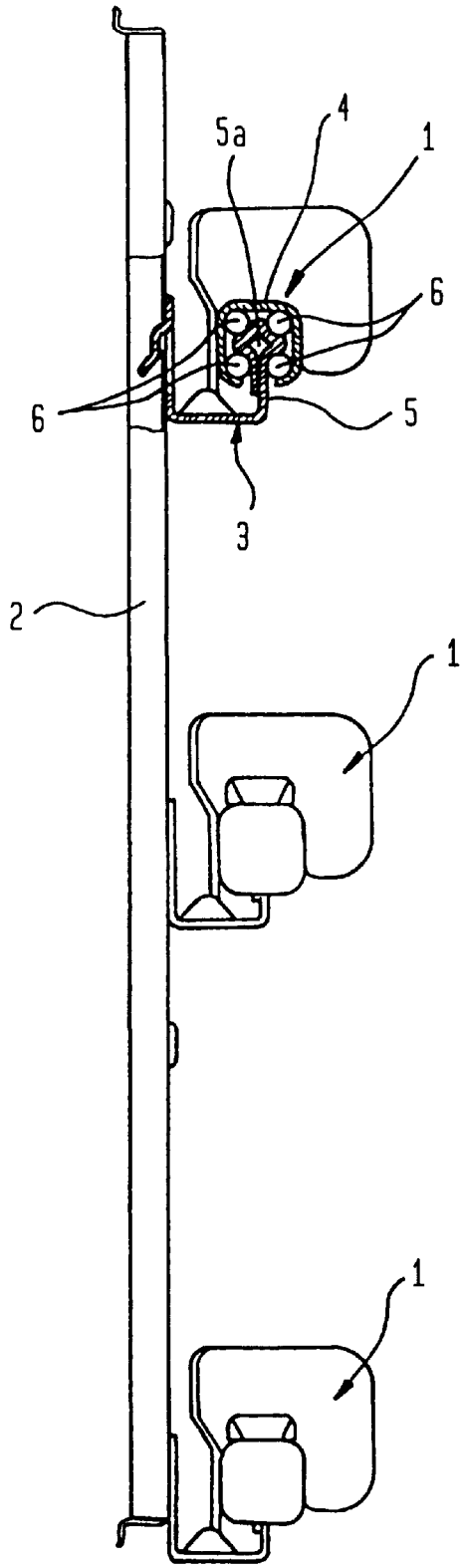
FIG. 2 is a front view of the track assembly, taken in direction of arrow II in FIG.1, with one of the track assemblies being shown by a sectional view.

As shown in FIG. 2, each track assembly 1 includes essentially a guide rail 3 which is secured to the mounting rails 2, and a runner 4 which is slidable along the guide rail 3 and coupled to a pull-out slide member (not shown). In the exemplified embodiment, the runner 4 is formed, in a manner known per se, as a tubular outer rail which is slotted in longitudinal direction, and the guide rail 3 constitutes an inner rail which is formed with a wall section 5 for projection into the guide rail 3. Formed on the free longitudinal edge 5*a* of the wall section 5 are races for receiving rolling elements or balls 6 which are retained in a cage (not shown) for support of the guide rail 3. This type of design is known per se and realizes a smooth run between the runner 4 and the guide rail 3 of the track assembly 1; However, as described above, this smooth sliding action of the track assembly 1 is not desired, when used for cooking trays in baking ovens, as involved here.

In the following description, the term "smooth" will denote an operation of the track assembly which is realized substantially without resistance of the sliding motion between the guide rail and the runner, while the term "sluggish" will denote the application of a resistance to impede a sliding motion. The term "front" or "forward" will denote a direction toward those portions of the track assembly which appear on the left hand side of e.g. FIGS. 3 or 4.

In order to impede a smooth run between the guide rail 3 and the runner 4 and thus to afford a respective sluggishness, the track assembly 1 has incorporated therein a brake mechanism, generally designated by reference numeral 7, which is secured to the guide rail 3 and abuts at least one flank 9 of the runner 4, as will be now described in more detail with reference to FIGS. 3 and 4.

The brake mechanism 7 includes two form-parts 7*a* which are in interlocking engagement and movable relative to each other. Extending between the form-parts 7*a* is a spring 8 for pushing apart the form-parts 7*a*. Depending on the predetermined force applied by the spring 8, the brake mechanism 7 realizes a braking and damping action, thereby impeding the design-inherent smooth sliding action of the track assembly 1.

The form-parts 7*a* are preferably made of plastic material and of identical design. As best seen from FIG. 8, each form-part 7*a* has a base 20 and two bars 11 extending outwardly from the base 20 in spaced-apart parallel disposition for defining an anchoring groove 90 therebetween. At their base-distal ends, the bars 11 are formed with undercuts 12 for defining ledge surfaces for engagement of complementary undercuts 12 on a locking member 10 of the other form-part 7*a*, with the locking member 10 being secured to the base 20 at a distance to the bars 11. Positioned between the bars 11 and the locking member 10 is a pin 13 for support of the spring 8 which is made of spring wire.

Figure 8:
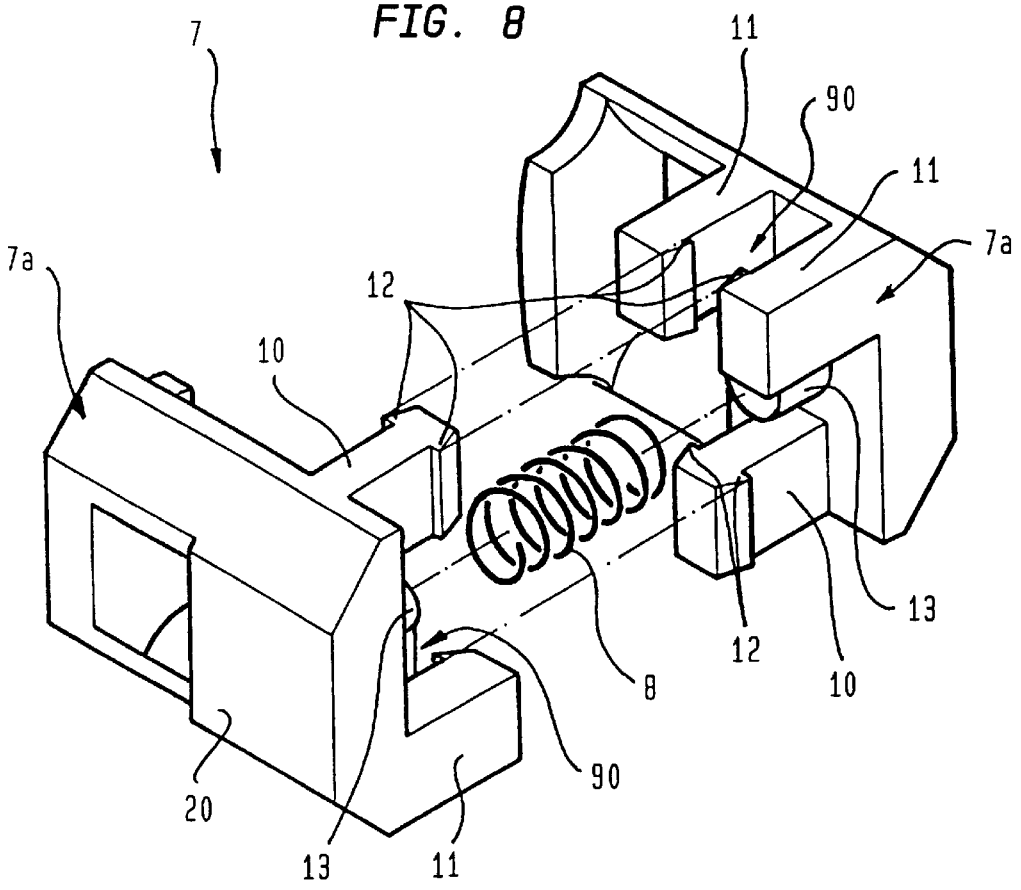
FIG. 8 is a top, side perspective view, in exploded illustration, of the brake mechanism of FIGS. 6 and 7 prior to final assembly.

As shown in FIG. 8, the form-parts 7*a* are positioned in inverse relationship to one another and then pushed together so that the locking member 10 of one form-part 7*a* is received in the anchoring groove 90 of the other form-part 7*a* and snaps behind the ledges surfaces of the undercuts 12, with the spring 8 being tensioned between the form-parts 7*a*.

Figure 3:
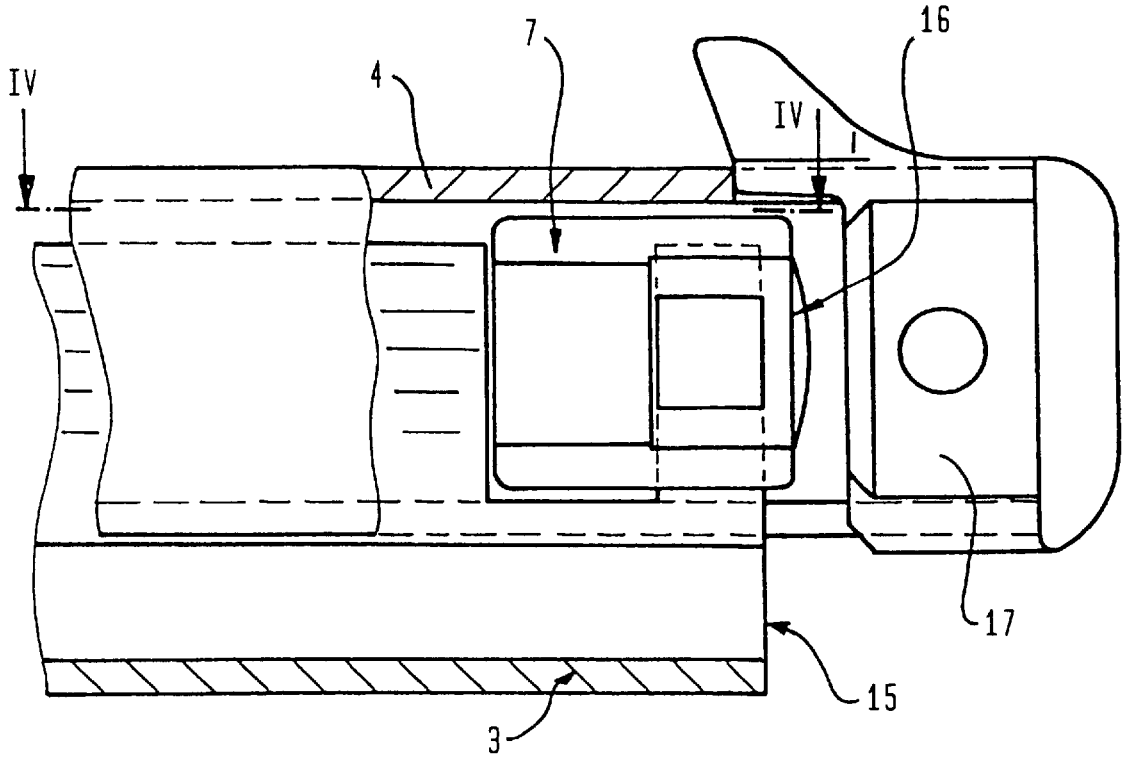
FIG. 3 is a fragmentary, partially sectional view, on an enlarged scale, of a front end of a track assembly according to the present invention.
Figure 4:
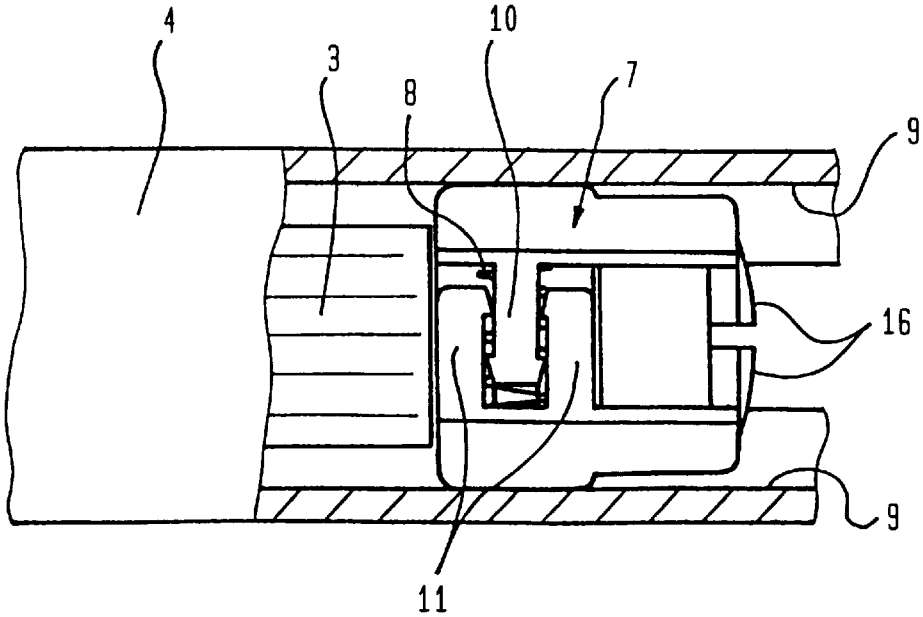
FIG. 4 is a partially sectional view of the track assembly, taken along the line IV—IV in FIG. 3.

The thus assembled brake mechanism 7, shown in FIG. 6, is placed in a pocket 14 or recess (FIG. 5) formed at a forward portion of the guide rail 3 and is so secured in the pocket 14 that the brake mechanism 7 projects with its front region 16 beyond the forward end face 15 of the guide track 3, as shown in particular in FIGS. 3 and 4, to thereby serve as a damping element which impacts an end cover 17 placed over the front end of the runner 4. Preferably, the outwardly projecting region 16 has an arched configuration.

In operation, the spring 8 pushes the form-parts 7*a* apart to such an extent that at least one of the form-parts 7*a* abuts against the confronting flank (side wall) 9 of the runner 4 to thereby impede the sliding action of the track assembly 1. Persons skilled in the art will understand that the brake mechanism 7 may certainly be so configured that both form-parts 7*a* abut against the confronting flanks 9 of the runner 4.

Figure 9:
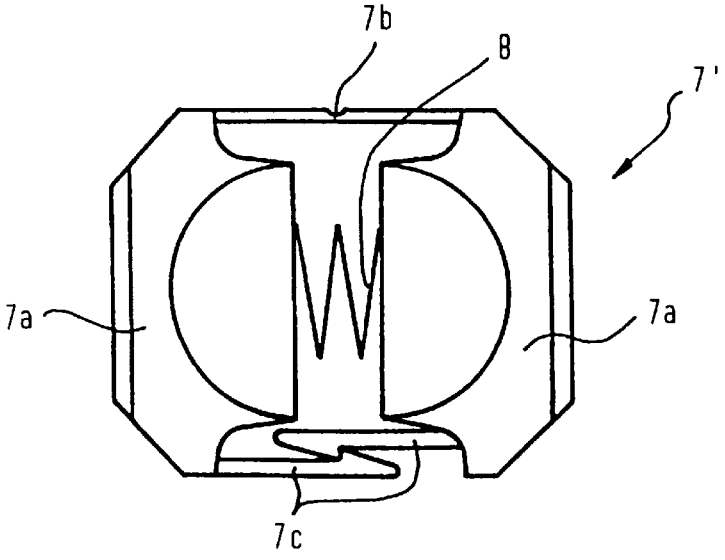
FIG. 9 is a schematic view, similar to FIG. 7, of a modified brake mechanism for a track assembly according to the invention.

Turning now to FIG. 9, there is shown a schematic view of a modified brake mechanism 7' which differs from the preceding brake mechanism 7 by the provision of a film-type hinge 7*b* for captivating the form-parts 7*a* and thereby permanently coupling together the form-parts 7*a*. Thus, the form-parts 7*a* for the brake mechanism 7 are available as necessary pairs the assembly of the brake mechanism 7. In addition, the interlocking engagement of the form-parts 7*a* is realized by locking elements 7*c* which are provided on the side opposite to the film-type hinge 7*b* and snap together to join the form-parts 7*a*.

Figure 11:
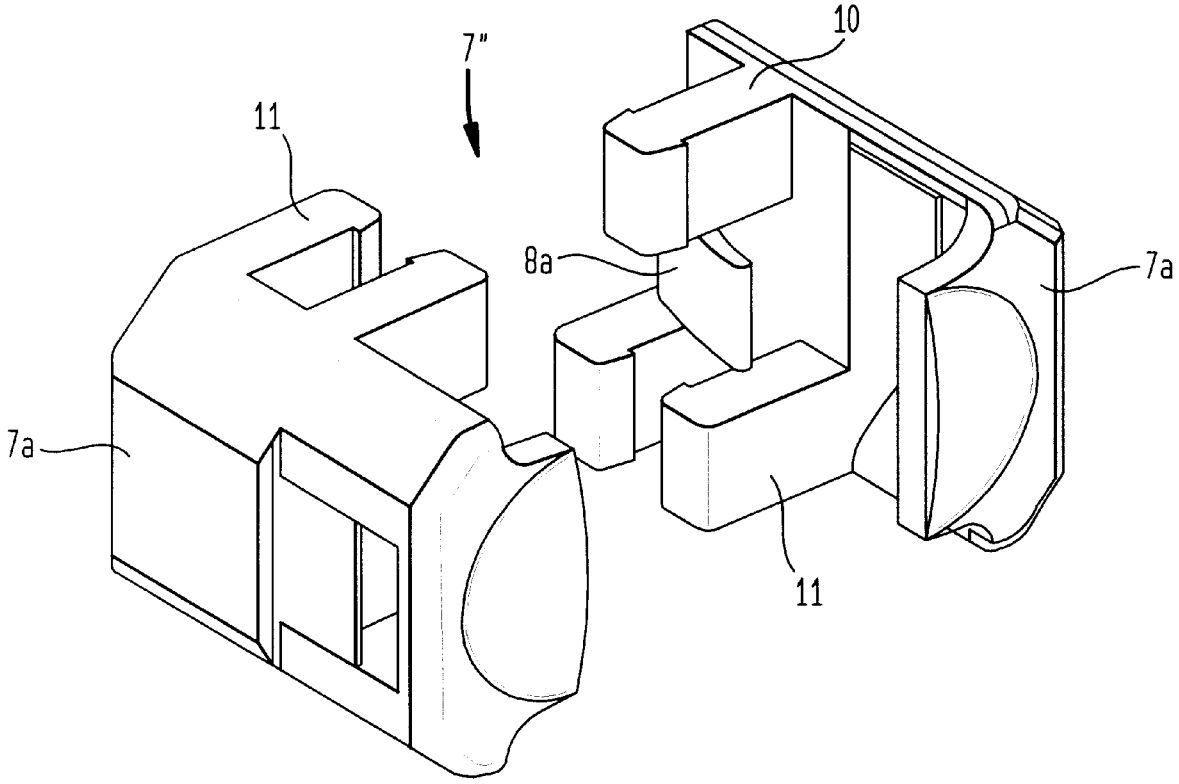
FIG. 11 is a top, side perspective view, in exploded illustration, of still another modified brake mechanism for a track assembly according to the invention, prior to assembly.
Figure 12:
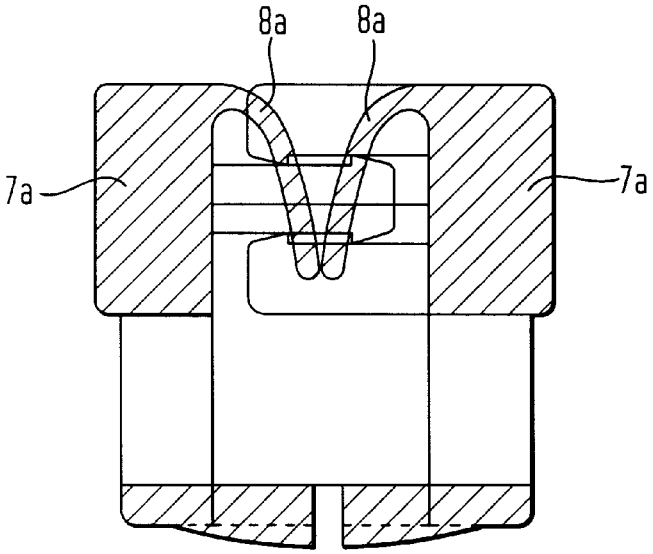
FIG. 12 is a schematic sectional view of the fully assembled brake mechanism of FIG. 11.

Persons skilled in the art will understand that instead of using a separate spring, i.e. spring 8, for pushing the form-parts 7*a* apart, one or both form-parts 7*a* to be joined may be provided with a leg spring 8*a* to push the form-parts 7*a* apart as shown by way of example in FIGS. 11 and 12 which illustrate a corresponding brake mechanism 7".

Figure 10:
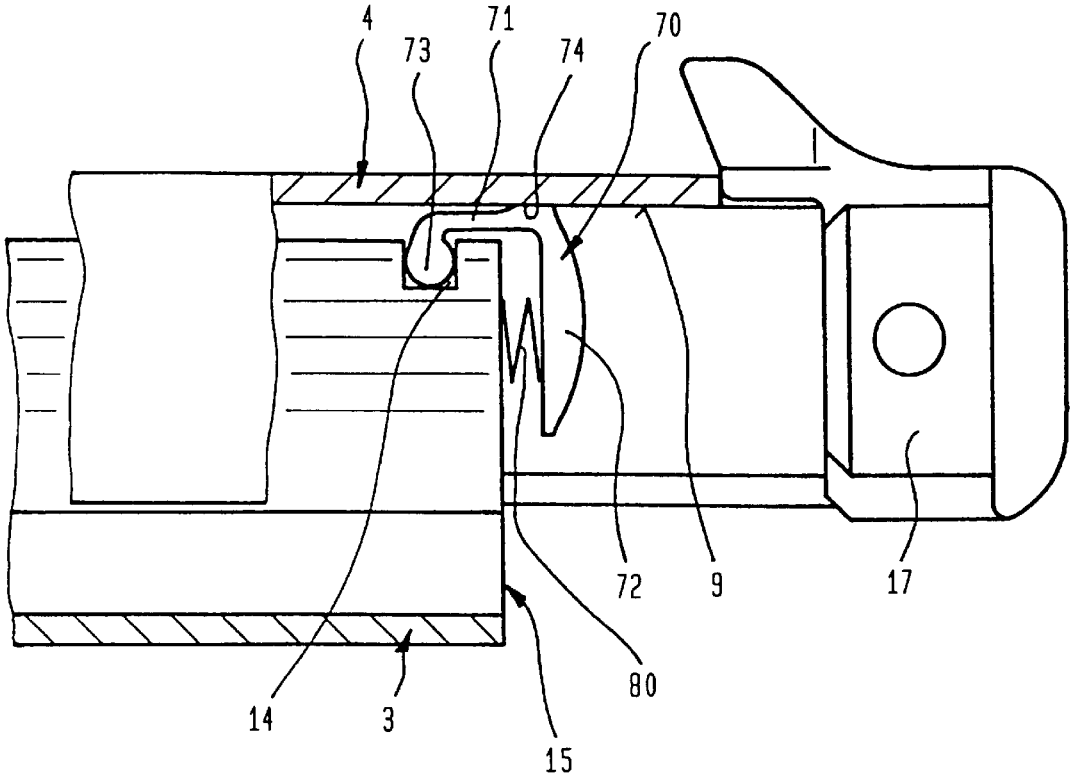
FIG. 10 is a enlarged, schematic, partially sectional view, similar to FIG. 3, of a front end of another embodiment of a track assembly according to the present invention.

Turning now to FIG. 10, there is shown another embodiment of a track assembly according to the present invention which includes a brake mechanism 70 of angled configuration. The brake mechanism 70 includes a first brake member 71, which extends approximately parallel to the operating direction of the runner 4, and a second brake member 72 which extends at a right angle to the first brake member 71. The second brake member 72 projects beyond the front end face 15 of the guide rail 3 approximately vertical to the longitudinal axis of the runner 4 and is acted upon by a spring 80 which extends between the second member 72 and the front end face 15 of the guide rail 3.

The brake member 71 of the brake mechanism 70 is formed distal to the brake member 72 with a bulbed end 73 for engagement in a pocket 14 of the guide rail 3 to secure the brake mechanism 70 in place, and is provided with a brake cam 74 which is urged by the spring 80 against the upper confronting flank 9 of the runner 4. Also in this embodiment, a permanent braking action is realized between the guide rail 3 and the runner 4, with the braking action predominantly determined by the contact force applied by the spring 80.

The brake member 72 which projects beyond the front end face 15 of the guide rail 3 serves also as a damping element in cooperation with the confronting end of the end cover 17 of the runner 4.

It will be appreciated by persons skilled in the art that the application of a track assembly according to the invention for a baking oven requires certainly the use of only such materials, in particular for the brake mechanism, which are resistant to heat and moisture.

While the invention has been illustrated and described as embodied in a track assembly for a pull-out member, it is not intended to be limited to the details shown since various modifications and structural changes may be made without departing in any way from the spirit of the present invention.

What is claimed as new and desired to be protected by Letters Patent is set forth in the appended claims:

1. A track assembly for a pull-out member comprising:

a stationary guide rail;

a runner slideable with respect to the guide rail in an operating direction between extended and retracted positions; and a spring-biased brake mechanism mounted transversely to the operating direction of the runner and bearing upon at least one flank of the runner to thereby impose a resistance to a sliding motion of the runner relative to the guide rail when moving the runner in the operating direction.

2. The track assembly of claim 1, wherein the brake mechanism bears upon two confronting flanks of the runner.

3. The track assembly of claim 1 wherein the guide rail has a front end, said brake mechanism being secured on the front end of the guide rail.

4. The track assembly of claim 1 wherein the guide rail has a front end face, said brake mechanism including a damping element which projects beyond the front end face of the guide rail.

5. The track assembly of claim 1 wherein the brake mechanism includes two plastic form-parts which are adapted for interlocking engagement and slide relative to one another, and at least one spring member extending between the two form-parts for pushing the form-parts apart.

6. The track assembly of claim 5 wherein the spring member is a helical spring made of spring wire.

7. The track assembly of claim 5 wherein the spring member is a leg spring formed on at least one of the form-parts and acting on the one of the form-parts.

8. The track assembly of claim 5 wherein the two form-parts are of identical design.

9. The track assembly of claim 5, and further comprising a film-type hinge for connecting the two form-parts to each other.

10. The track assembly of claim 1 wherein the brake mechanism includes a first brake member extending approximately parallel to the operating direction of the runner, a brake cam formed on the first brake member and bearing upon the flank of the runner, a second brake member projecting beyond a front end face of the guide rail and extending approximately perpendicular to the operating direction of the runner, and a spring member supported by the front end face of the guide rail for biasing the second brake member.

11. The track assembly of claim 1 wherein the runner comprises a tubular outer rail slotted in the operating direction, and the guide rail comprises an inner rail having a wall section projecting into the outer rail and having a free longitudinal edge so formed as to exhibit races for rolling elements retained in a cage and supported by the outer rail, said brake mechanism being secured in a pocket of the longitudinal edge of the wall section of the inner rail.

* * * * *